US007658647B2

(12) United States Patent
Reker

(10) Patent No.: US 7,658,647 B2
(45) Date of Patent: Feb. 9, 2010

(54) CABLE ARRANGEMENT WITH SHIELDED CABLES

(75) Inventor: Stefan Reker, Bielefeld (DE)

(73) Assignee: Weidmuller Interface GmbH & Co. KG, Detwold (DE)

( * ) Notice: Subject to any disclaimer, the term of this patent is extended or adjusted under 35 U.S.C. 154(b) by 0 days.

(21) Appl. No.: 12/287,552

(22) Filed: Oct. 10, 2008

(65) Prior Publication Data

US 2009/0104815 A1 Apr. 23, 2009

(30) Foreign Application Priority Data

Oct. 15, 2007 (DE) ..... 20 2007 014 490 U

(51) Int. Cl.
*H01R 9/03* (2006.01)

(52) U.S. Cl. ..... 439/607.41

(58) Field of Classification Search ..... 439/607.15, 439/607.41, 607.42, 607.45, 402, 411, 394
See application file for complete search history.

(56) References Cited

U.S. PATENT DOCUMENTS 4,701,137 A * 10/1987 DeRoss ..... 439/394
5,044,978 A * 9/1991 Gelin ..... 439/394
5,306,870 A * 4/1994 Abat ..... 174/659
6,036,539 A * 3/2000 Rigby et al. ..... 439/579
6,443,756 B1 * 9/2002 Hagmann et al. ..... 439/402

FOREIGN PATENT DOCUMENTS

| | | |
|---|---|---|
| DE | 37 20 507 C2 | 12/1988 |
| DE | 38 22 573 C2 | 1/1990 |
| DE | 200 01 912 U1 | 7/2001 |
| EP | 0 400 521 B1 | 7/1994 |

* cited by examiner

*Primary Examiner*—Edwin A. Leon
(74) *Attorney, Agent, or Firm*—Lawrence E. Laubscher, Sr.; Lawrence E. Laubscher, Jr.

(57) ABSTRACT

Connector apparatus electrically connects together a plurality of shielded cables, including a housing containing a chamber including a first opening for receiving one end of a first shielded cable, and at least two second openings receiving the one ends of at least two second shielded cables, respectively. A conductive shield associated with the housing connects together the shielding layers of all of the cables, and a printed circuit board arranged in the housing connects at least one conductor of at least two of the second cables with a corresponding conductor of the first cable.

4 Claims, 2 Drawing Sheets

CABLE ARRANGEMENT WITH SHIELDED CABLES

BACKGROUND OF THE INVENTION

1. Field of the Invention

Connector apparatus electrically connects together a plurality of shielded cables, including a housing containing a chamber including a first opening for receiving one end of a first shielded cable, and at least two second openings receiving the one ends of at least two second shielded cables, respectively. A conductive shield associated with the housing connects together the shielding layers of all of the cables, and a printed circuit board arranged in the housing connects at least one conductor of at least two of the second cables with a corresponding conductor of the first cable.

2. Description of Related Art

In the field of automation techniques, one repeatedly encounters the problem with cables having patch connectors using the so-called M-standard (i.e., M8 or M12 standard), of making suitable twin or T-shaped connections. Currently, the solutions to these problems include: (a) the use of commonly manufactures patch connectors with a cable screw connection having two inputs, (b) a T-piece connection without cable and having three plugs, and (c) one line where two cables come out of one plug. These solutions work well for unshielded electrical cables, but they are not suitable for shielded cables because the cable shields cannot readily be placed twice on a single plug.

The present invention was developed to provide an improved T-type connection for shielded cables.

SUMMARY OF THE INVENTION

Accordingly, a primary object of the present invention is to provide a connector housing including shield means for connecting together all of the shielding layers of a plurality of shielded cables, and connecting means for connecting together certain conductors of a plurality of second cables with a corresponding conductor of a first cable. Preferably, the conductor connecting means includes a printed circuit board having T-shaped strip conductors.

According to a first embodiment of the invention, the connector housing is formed from an electrically insulting synthetic plastic material, and the shield means comprises either a layer of conductive shielding metallic material lining the interior wall of the housing, or a layer of sheet metal shielding material enclosing the connecting means. According to a second embodiment, the connector housing is formed of conductive metal and serves itself as the shield means for the connecting means.

According to another feature of the invention, prefabricated plug or socket connectors are connected with the other ends of the shielded cables.

BRIEF DESCRIPTION OF THE DRAWINGS

Other objects and advantages of the invention will become apparent from a study of the following specification, when viewed in the light of the accompanying drawing, in which.

DETAILED DESCRIPTION OF THE INVENTION

Figure 1:
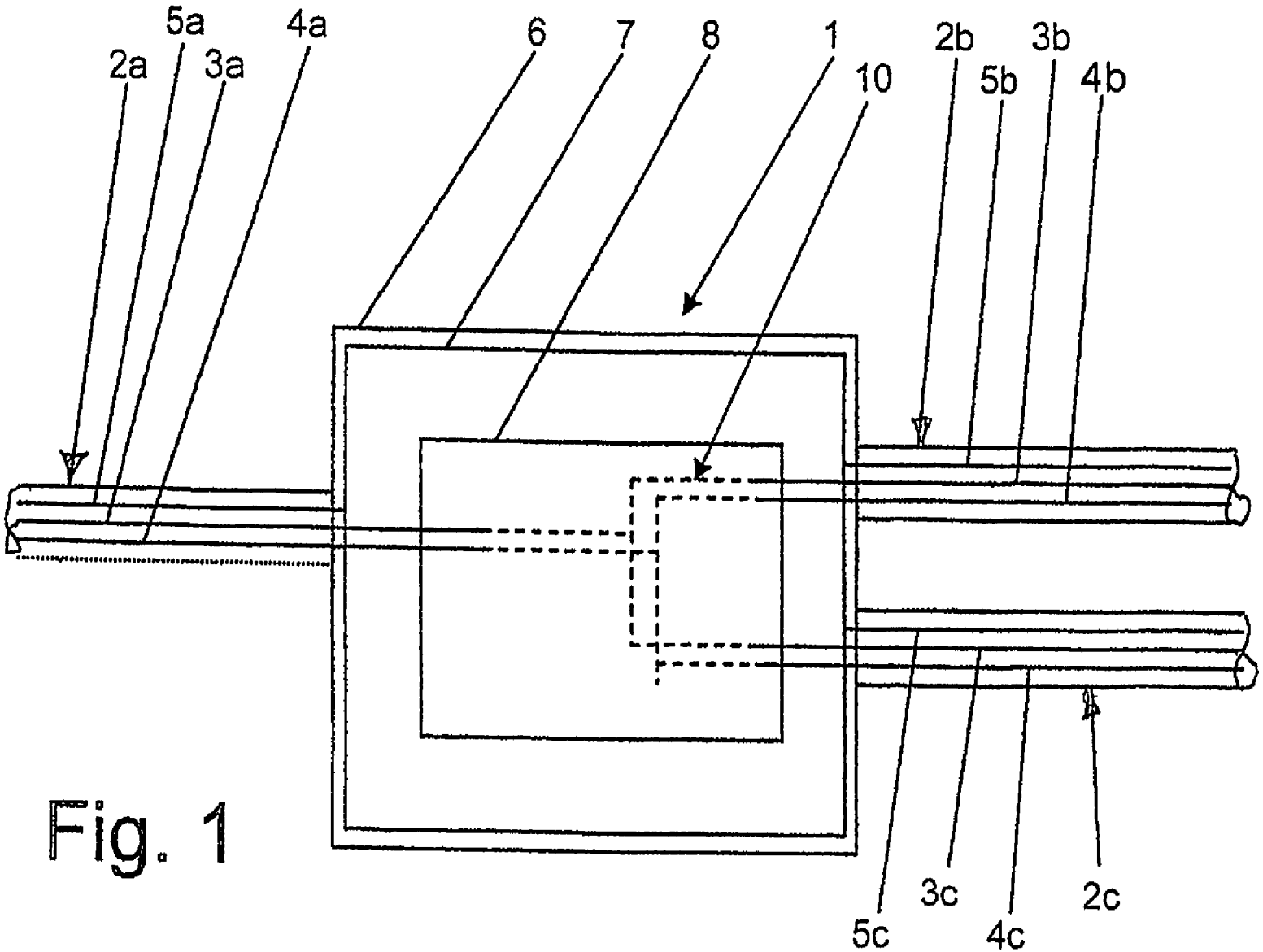
FIG. 1 is a diagrammatic illustration of the connector arrangement of the present invention for connecting together a plurality of shielded conductors.

Referring first more particular to the diagrammatic representation of FIG. 1, the connector apparatus 1 of the present invention includes a housing 6 containing a chamber and having a first opening for receiving one end of a first shielded cable 2*a*, and a pair of second openings for receiving the one ends of a pair of second shielded cables 2*b* and 2*c*. said cables containing a plurality of conductors 3*a*,4*a*; 3*b*,4*b*; and 3*c*,4*c*, respectively, and a conductive cable shield means 5*a*, 5*b*, and 5*c*, respectively. The housing 6 contains housing shield means 7 to which are electrically connected (for example, by soldering) each of the cable shield means 5*a*-5*c*. The housing chamber also contains a printed circuit board 8 having T shaped printed conductor strips 10 thereon which electrically connect certain conductors of the second cables with a corresponding conductor of the first cable (i.e., conductors 3*b* and 3*c* are connected with conductor 3*a*, and conductors 4*b* and 4*c* are connected with conductor 4*a*).

Preferably the housing 6 is formed from an electrically insulating synthetic plastic material, and the shield means 7 comprises a layer of conductive metallic material lining the inner wall surface of the chamber. Alternatively, the shield means could be formed from conductive metal sheet material. In a second embodiment, the housing 6 is formed from a conductive metallic material, whereby the housing serves as the shield means.

Figure 2:
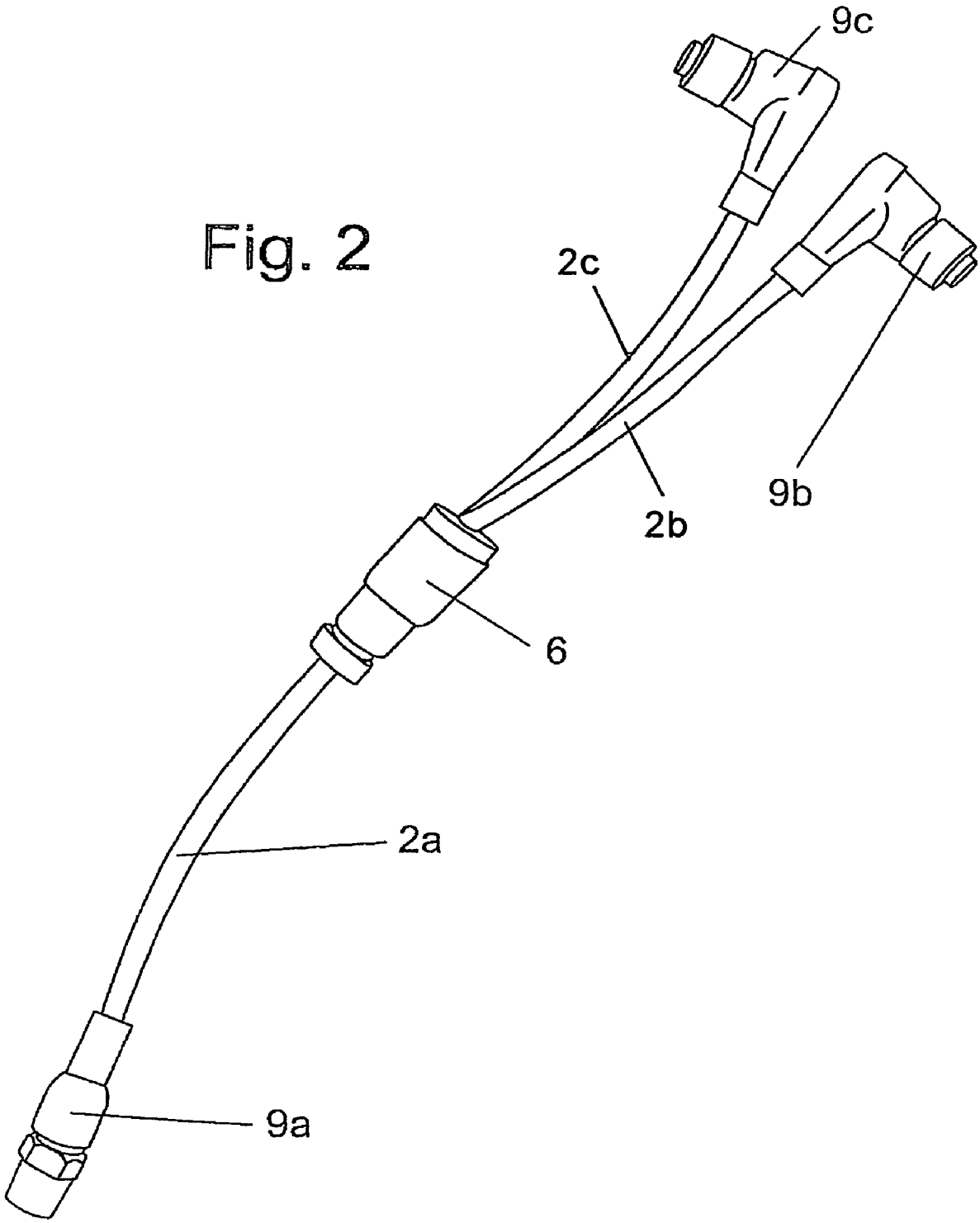
FIG. 2 is a perspective view of a plurality of shielded cables connected together by the connector means of the present invention.

As shown in FIG. 2, plug or socket M-type connectors 9*a*, 9*b* and 9*c* (such as M8 or M12 connectors) are provided, preferably in a pre-assembled manner, at the second ends of the cables 2*a*, 2*b* and 2*c*, respectively.

Housing 6 can have any desired shape. Particularly suitable would be a sleeve design provided at its ends with one or two passages for the cables, which sleeve design is closed and metal coated, or a flat housing coated on its interior with a metal layer, which connector after assembly is cast with sealant to achieve a high degree of impermeability. Also, it is conceivable to use a solid metal housing so that the housing serves as the metal shield.

The cable device, thus prefabricated, can easily be connected with additional patch plug parts in order to make a shielded T-piece connection with shielded cables.

While in accordance with the provisions of the Patent Statutes the preferred forms and embodiments of the invention have been illustrated and described, it will be apparent to those skilled in the art that changes may be made without deviating from the invention described above.

What is claimed is:

1. Connector apparatus for electrically connecting together a plurality of electrical shielded cables each including a plurality of conductors having first and second ends, and a conductive shielding layer electrically shielding said conductors, comprising:

(a) a connector housing (6) containing a chamber, said housing being formed from an electrically insulating synthetic plastic material and including a first opening for receiving one end of a first cable (2*a*), and at least two second openings receiving the one ends of at least two second cables (2*b*, 2*c*), respectively;

(b) shield means associated with said housing for connecting together the shielding layers of all of the cables, said shield means comprising a metal coating (7) lining said housing chamber, the shielding layers of all of said cables being soldered to said metal coating; and (c) connecting means arranged in said housing for connecting the first ends of the conductors (3*b*, 4*b*; 3*c*, 4*c*) of the second cables with corresponding first ends of the conductors (3*a*, 4*a*) of said first cable, respectively, said connecting means comprising a printed circuit board (8) arranged in said chamber, said printed circuit board having a plurality of generally T-shaped conductive strips (10) operable to electrically connect the second cable conductors with the associated first cable conductors, respectively.

2. Connector apparatus as defined in claim 1, and further including electrical connector means (9*a*, 9*b*, 9*c*) connected with the second ends of said first and second cables, respectively.

3. Connector apparatus for electrically connecting together a plurality of electrical shielded cables each including a plurality of conductors having first and second ends, and a conductive shielding layer electrically shielding said conductors comprising:

(a) a connector housing (6) containing a chamber, said housing being formed from an electrically insulating synthetic plastic material and including a first opening for receiving one end of a first cable (2*a*), and at least two second openings receiving the one ends of at least two second cables (2*b*, 2*c*), respectively;

(b) shield means associated with said housing for connecting together the shielding layers of all of the cables, said shield means comprising a layer of conductive metal sheet material arranged in said chamber, the shielding layers of all of said cables being soldered to said conductive metal sheet layer; and (c) connecting means arranged in said housing for connecting the first ends of the conductors (3*b*, 4*b*; 3*c*, 4*c*) of the second cables with corresponding first ends of the conductors (3*a*, 4*a*) of said first cable, respectively, said connecting means comprising a printed circuit board (8) arranged in said chamber, said printed circuit board having a plurality of generally T-shaped conductive strips (10) operable to electrically connect the second cable conductors with the associated first cable conductors, respectively.

4. Connector apparatus as defined in claim 3, and further including electrical connector means (9*a*, 9*b*, 9*c*) connected with the second ends of said first and second cables, respectively.

* * * * *